US006570126B2

(12) United States Patent
Suh et al.

(10) Patent No.: US 6,570,126 B2
(45) Date of Patent: May 27, 2003

(54) SIMULTANEOUS OFFSET DUAL SIDED LASER SHOCK PEENING USING LOW ENERGY LASER BEAMS

(75) Inventors: Ui Won Suh, Cincinnati, OH (US); Seetharamaiah Mannava, Cincinnati, OH (US); Todd Jay Rockstroh, Maineville, OH (US)

(73) Assignee: General Electric Company, Schenectady, NY (US)

( * ) Notice: Subject to any disclaimer, the term of this patent is extended or adjusted under 35 U.S.C. 154(b) by 33 days.

(21) Appl. No.: 09/945,191

(22) Filed: Aug. 31, 2001

(65) Prior Publication Data

US 2003/0042234 A1 Mar. 6, 2003

(51) Int. Cl.[7] ..... B23K 26/00
(52) U.S. Cl. ..... 219/121.85; 148/525
(58) Field of Search ..... 219/121.85, 121.76, 219/121.77, 121.68, 121.69, 121.73, 121.75; 148/525, 565

(56) References Cited

U.S. PATENT DOCUMENTS

| | | | | |
|---|---|---|---|---|
| 5,531,570 A | | 7/1996 | Mannava et al. | |
| 5,591,009 A | | 1/1997 | Mannava et al. | |
| 5,674,328 A | | 10/1997 | Mannava et al. | |
| 5,674,329 A | | 10/1997 | Mannava et al. | |
| 5,756,965 A | | 5/1998 | Mannava | |
| 5,911,890 A | * | 6/1999 | Dulaney et al. | 219/121.85 |
| 5,911,891 A | | 6/1999 | Dulaney et al. | |
| 5,932,120 A | | 8/1999 | Mannava et al. | |
| 5,948,293 A | | 9/1999 | Somers et al. | |
| 5,951,790 A | | 9/1999 | Mannava et al. | |
| 5,987,042 A | | 11/1999 | Staver et al. | |
| 6,064,035 A | | 5/2000 | Toller et al. | |
| 6,236,016 B1 | | 5/2001 | Dulaney et al. | |
| 6,296,448 B1 | * | 10/2001 | Suh et al. | 416/241 R |

FOREIGN PATENT DOCUMENTS

| | | | | |
|---|---|---|---|---|
| EP | 933438 | * | 8/1999 | C21D/10/00 |

OTHER PUBLICATIONS

U.S. patent application Ser. No. 09/771,856, Filed Jan. 29, 2001, "Laser Shock Peening Integrally Bladed Rotor Blade Edges", Case No. 13DV–13618.

U.S. patent application Ser. No. 09/438,513, Filed Nov. 12, 1999, "Simultaneous Offset Dual Sided Laser Shock Peening", Case No. 13DV–12942.

* cited by examiner

*Primary Examiner*—M. Alexandra Elve
(74) *Attorney, Agent, or Firm*—VG Ramaswamy; Steven J. Rosen

(57) ABSTRACT

A method for laser shock peening an article by simultaneously firing low energy first and second laser beams to form pairs of longitudinally spaced apart first and second laser shock peened spots that are on opposite sides of the article, simultaneously laser shock peened, and transversely offset from each other. Each of the low energy first and second laser beams having a level of energy of between 1–10 joules.

22 Claims, 5 Drawing Sheets

SIMULTANEOUS OFFSET DUAL SIDED LASER SHOCK PEENING USING LOW ENERGY LASER BEAMS

BACKGROUND OF THE INVENTION

1. Field of the Invention

This invention relates to laser shock peening and, more particularly, to methods of simultaneously laser shock peening opposite sides of an article using offset low energy laser beams.

2. Background Art

Laser shock peening or laser shock processing, as it is also referred to, is a process for producing a region of deep compressive residual stresses imparted by laser shock peening a surface area of an article. Laser shock peening typically uses one or more radiation pulses from high energy, about 50 joules or more, pulsed laser beams to produce an intense shockwave at the surface of an article similar to methods disclosed in U.S. Pat. No. 3,850,698 entitled "Altering Material Properties"; U.S. Pat. No. 4,401,477 entitled "Laser Shock Processing"; and U.S. Pat. No. 5,131,957 entitled "Material Properties". Laser shock peening, as understood in the art and as used herein, means utilizing a pulsed laser beam from a laser beam source to produce a strong localized compressive force on a portion of a surface by producing an explosive force at the impingement point of the laser beam by an instantaneous ablation or vaporization of a thin layer of that surface or of a coating (such as tape or paint) on that surface which forms a plasma.

Laser shock peening is being developed for many applications in the gas turbine engine field, some of which are disclosed in the following U.S. Pat. No. 5,756,965 entitled "On The Fly Laser Shock Peening"; U.S. Pat. No. 5,591,009 entitled "Laser shock peened gas turbine engine fan blade edges"; U.S. Pat. No. 5,531,570 entitled "Distortion control for laser shock peened gas turbine engine compressor blade edges"; U.S. Pat. No. 5,492,447 entitled "Laser shock peened rotor components for turbomachinery"; U.S. Pat. No. 5,674,329 entitled "Adhesive tape covered laser shock peening"; and U.S. Pat. No. 5,674,328 entitled "Dry tape covered laser shock peening", all of which are assigned to the present Assignee.

Laser peening has been utilized to create a compressively stressed protective layer at the outer surface of an article which is known to considerably increase the resistance of the article to fatigue failure as disclosed in U.S. Pat. No. 4,937,421 entitled "Laser Peening System and Method". These methods typically employ a curtain of water flowed over the article or some other method to provide a plasma confining medium. This medium enables the plasma to rapidly achieve shockwave pressures that produce the plastic deformation and associated residual stress patterns that constitute the LSP effect. The curtain of water provides a confining medium, to confine and redirect the process generated shockwaves into the bulk of the material of a component being LSP'D, to create the beneficial compressive residual stresses.

The pressure pulse from the rapidly expanding plasma imparts a traveling shockwave into the component. This compressive shockwave caused by the laser pulse results in deep plastic compressive strains in the component. These plastic strains produce residual stresses consistent with the dynamic modules of the material. Dual sided simultaneous laser shock peening includes simultaneously striking both sides of an article by two laser beams in order to increase the compressive residual stress in the material. The laser beams are typically balanced in order to minimize material distortion. The initial compressive waves pass through the material from each of the sides and are reflected back from the interface of the two initial compressive waves. The reflected waves turn into a tension wave. The combined tensile stress of the reflected waves, when the reflected tension waves from the both sides meet at mid-point in the same axial direction, can be greater than the strength that the material can handle and a crack can be initiated at the mid-plane where the two shockwaves meet.

Another characteristic of LSP that limits its engineering effectiveness is the formation of deleterious release waves that create tensile strains. The released waves may form spontaneously following the compressive front or may result from reflection at a surface with impedance mismatch such as at the outer surface of a component being laser shock peened. When multiple release waves are simultaneously propagating in a component, they may add in a manner termed superposition. This superposition of tensile waves may reduce the effectiveness of the beneficial compressive strains or may even cause tensile fracture within the component. This superposition of the two spatially concentric waves thus reduces the beneficial effects which may be measured by HCF testing.

Thus, it is highly desirable to have a process for and to produce an article that is simultaneously laser shock peened on two opposite sides and eliminate the mid-plane cracks by lowering the combined tensile stress of the reflected waves just below the maximum or allowable tensile stress of the material. It is also highly desirable to be able to eliminate or reduce loss of HCF benefits or effectiveness of the beneficial compressive strains from laser shock peening caused by the superposition of tensile waves.

Manufacturing costs of the laser shock peening process is a great area of concern because startup and operation costs can be very expensive. The use of low energy laser beams of this order of magnitude is disclosed in U.S. Pat. No. 5,932,120, entitled "Laser Shock Peening Using Low Energy Laser", which issued Aug. 3, 1999 and is assigned to the present assignee of this patent and is incorporated herein by reference. Manufacturers are constantly seeking methods to reduce the time, cost, and complexity of such processes and it is also to this end that the present invention is directed.

BRIEF DESCRIPTION OF THE INVENTION

A method for laser shock peening an article includes aiming and then simultaneously firing first and second low energy laser beams with sufficient energy to vaporize material on longitudinally spaced apart first and second surface portions of the article to form first and second regions having deep compressive residual stresses extending into the article from the first and second laser shock peened surface portions, respectfully. The low energy laser beams have low energy levels on the order of 3–10 joules or even perhaps 1–10 joules to allow smaller less expensive lasers to be used as disclosed in U.S. Pat. No. 5,932,120, entitled "Laser Shock Peening Using Low Energy Laser". The present method uses low energy laser beams having an output in a range of about 1–10 joules. An energy level range of about 3–7 joules has been found particularly effective as has an energy level of about 3 joules. The low energy beams are focused to produce small diameter laser spots having a diameter in a range of about 1 mm (0.040 in.) to 2 mm (0.080 in.). In one embodiment, the first and second laser beams are aimed such that first and second centerlines of the first and second laser beams impinge the first and second surface portions at first and second laser beam centerpoints through which pass parallel first and second axes that are substantially normal to the first and second surface portions at the first and second laser beam centerpoints, respectfully, and such that the first and second axes that are offset. In a first more particular embodiment of the present invention, the first and second laser beams are aimed such that the first and second centerlines intersect and are angled with respect to each other. In a second more particular embodiment of the present invention, the first and second laser beams and the first and second centerlines are parallel and offset with respect to each other.

Another more particular embodiment of the present invention, the laser beams are aimed and fired in a manner to produce first and second patterns on the first and second surface portions of the article having overlapping adjacent rows of overlapping adjacent one of the first and second spots, respectively. The patterns are formed by continuously moving the article, while holding stationary and continuously firing the laser beams with repeatable pulses with relatively constant periods between the pulses, wherein the surface portions are laser shock peened using sets of sequences, and wherein each sequence includes continuously firing the laser beams on the surfaces such that on each of the surface portions adjacent ones of the laser shock peened spots are hit in different ones of the sequences in the sets. A more particular embodiment includes coating the surface portions with an ablative coating before and in between the sequences in the set.

In one more embodiment of the present invention, the article is a gas turbine engine airfoil and the first and second surface portions are on pressure and suction sides, respectively, of the airfoil along a leading edge of the airfoil.

The present invention includes a laser shock peened article having laser shock peened first and second surface portions with first and second regions having deep compressive residual stresses extending into the article from the first and second laser shock peened surface portions, respectfully, wherein the first and second surface portions comprise couples of simultaneously laser shock peened first and second spots from laser shock peening, and each couple of the simultaneously laser shock peened first and second spots are longitudinally spaced apart and transversely offset from each other. In one embodiment of the present invention, the couple of the simultaneously laser shock peened first and second spots are substantially parallel. In one more particular embodiment of the present invention, the first and second surface portions of the article include first and second patterns of overlapping adjacent rows of overlapping adjacent ones of the first and second spots, respectively.

The present invention has many advantages including lowering the cost, time, man power and complexity of performing laser shock peening by allowing crack free dual sided simultaneous laser shock peening. The present invention provides a dual sided simultaneous laser shock peening method which is able to eliminate the mid-plane cracks by lowering the combined tensile stress of the reflected waves below the maximum or allowable tensile stress of the material. The invention provides a simultaneously dual sided laser shock peened article without the mid-plane cracks. The invention is also advantageous because it can be used to eliminate or reduce loss of HCF benefits or effectiveness of the beneficial compressive strains from laser shock peening caused by the superposition of tensile waves. The invention has been found useful to provide a positive effect on HCF capability of laser shock peened articles and in particular laser shock peened leading edges of airfoils gas turbine engine blades and vanes.

DETAILED DESCRIPTION OF THE INVENTION

Figure 1:
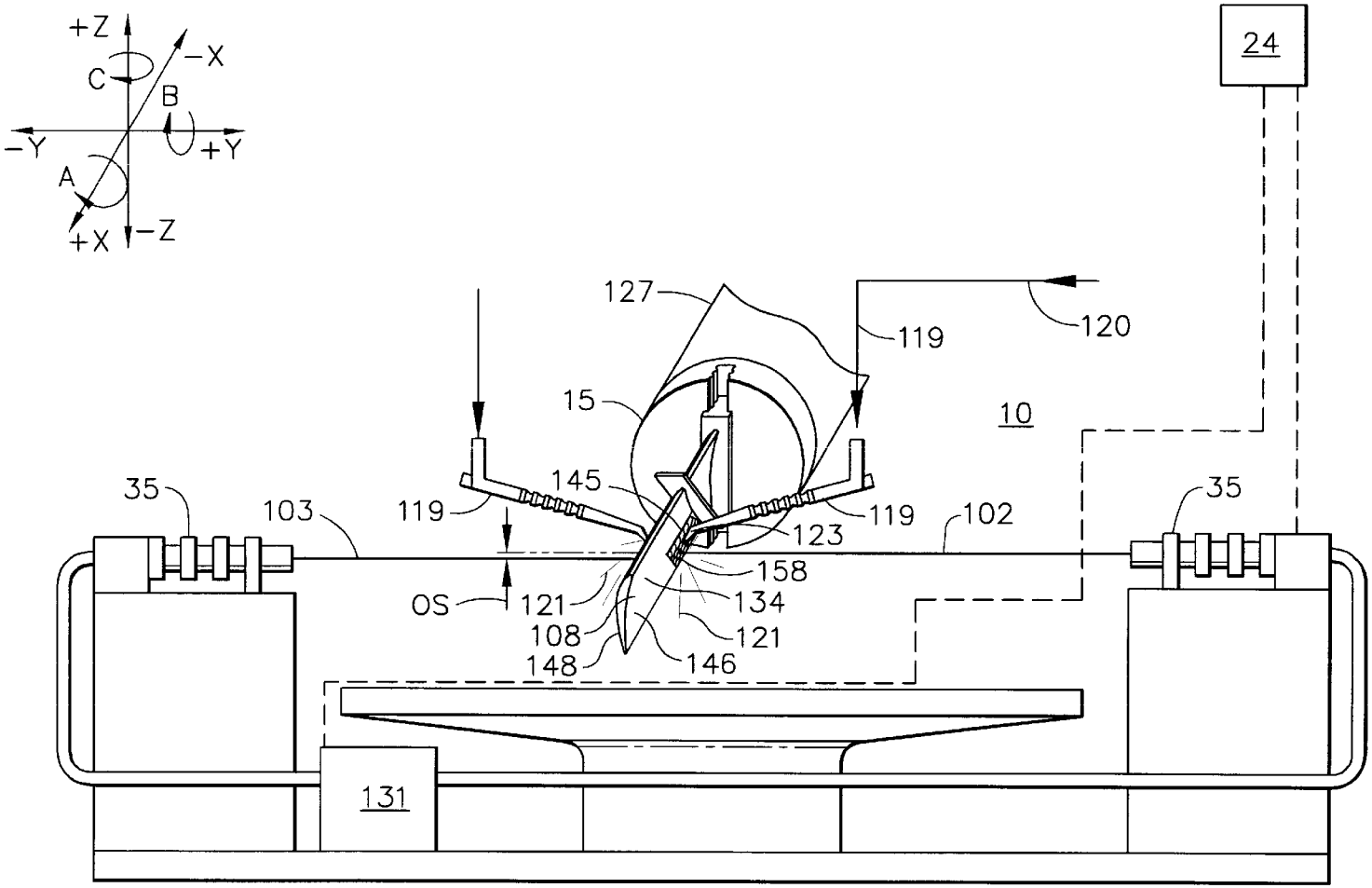
FIG. 1 is a schematic illustration of a gas turbine engine blade mounted in a laser shock peening system set up to laser shock peen using an exemplary embodiment of the method of the present invention.
Figure 2:
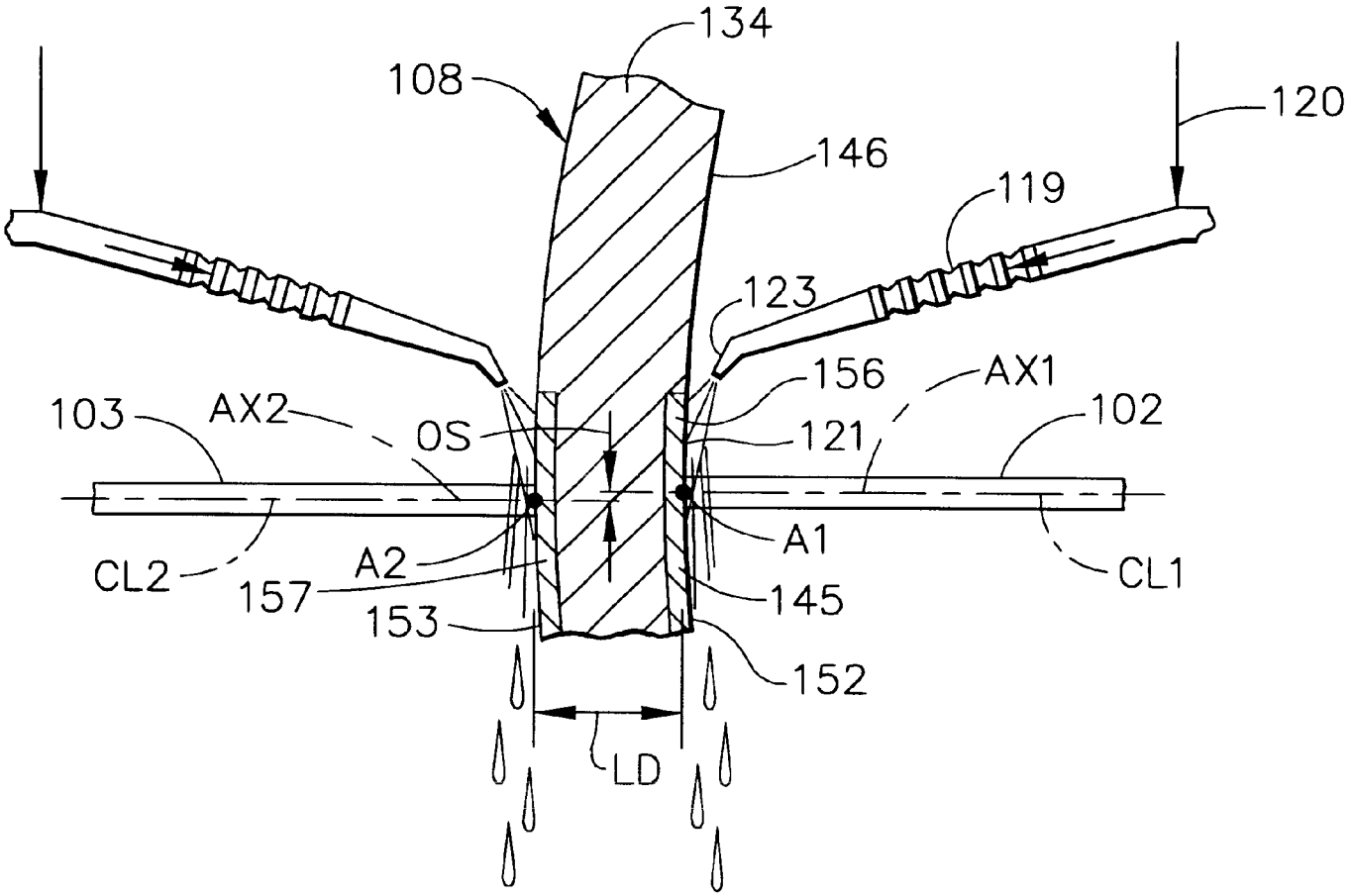
FIG. 2 is a cross-sectional schematic illustration of a portion of the blade illustrating the offset laser beams and laser shock peened spots of the exemplary embodiment of the method of the present invention.

Illustrated in FIGS. 1 and 2 is a schematic illustration of a laser shock peening system 10 that is used to laser shock peen articles exemplified by a gas turbine engine rotor blade 108 having an airfoil 134 with a patch 145 that is to be laser shock peened. The laser shock peening system 10 includes a generator 31 having an oscillator and a pre-amplifier and a beam splitter which feeds the pre-amplified laser beam into two beam optical transmission circuits and optics 35 that transmit and focus low energy first and second laser beams 102 and 103, respectively. The blade 108 is mounted in a fixture 15 which is attached to a five-axis computer numerically controlled (CNC) manipulator 127, one of which is commercially available from the Huffman Corporation, having an office at 1050 Huffman Way, Clover, S.C. 29710. The five axes of motion that are illustrated in the exemplary embodiment are conventional translational axes X, Y, and Z, and conventional first, second, and third rotational axes A, B, and C, respectively, that are well known in CNC machining. The manipulator 127 is used to continuously move and position the blade to provide laser shock peening "on the fly" in accordance with one embodiment of the present invention. Laser shock peening may be done in a number of various ways using paint or tape as an ablative medium (see in particular U.S. Pat. No. 5,674,329 entitled "Adhesive Tape Covered Laser Shock Peening").

Figure 5:
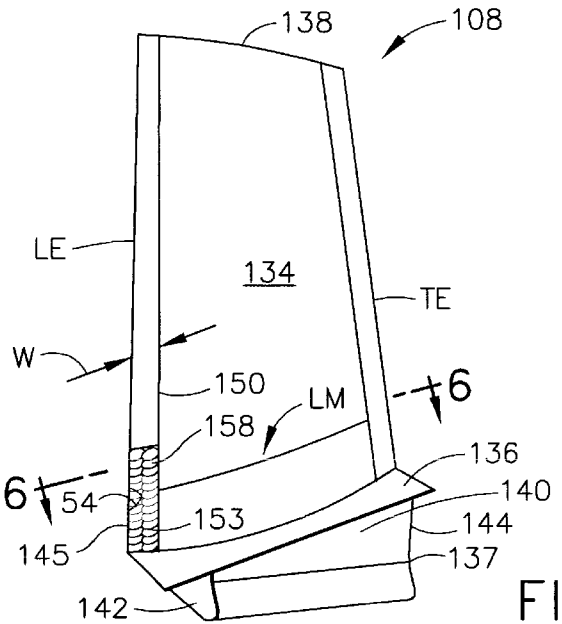
FIG. 5 is a perspective view of the fan blade in FIG. 1.
Figure 6:
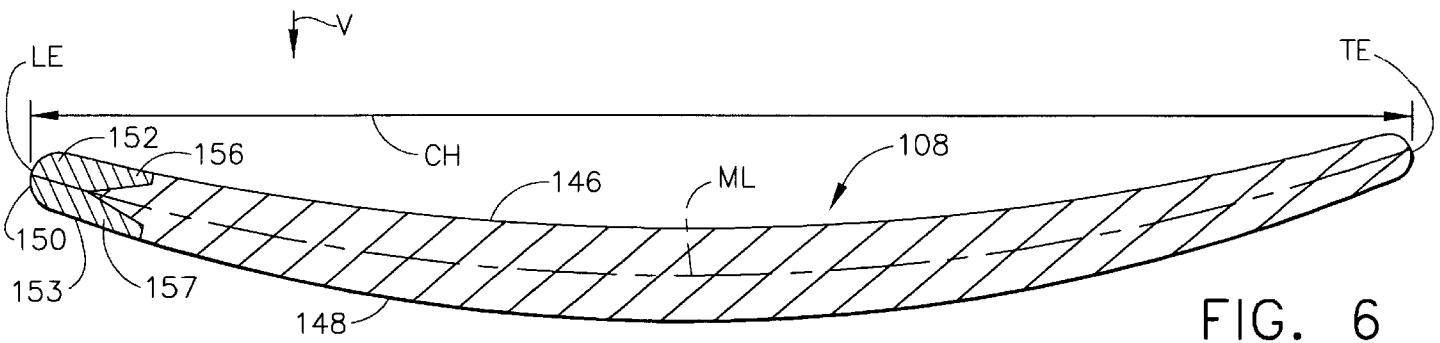
FIG. 6 is a cross-sectional view of the fan blade taken through line 6—6 in FIG. 5.

Referring to FIGS. 5 and 6, the blade 108 includes an airfoil 134 extending radially outward from a blade platform 136 to a blade tip 138. The blade 108 includes a root section 140 extending radially inward from the platform 136 to a radially inner end 137 of the root section 140. At the radially inner end 137 of the root section 140 is a blade root 142 which is connected to the platform 136 by a blade shank 144. The airfoil 134 extends in the chordwise direction between a leading edge LE and a trailing edge TE of the airfoil. A chord CH of the airfoil 134 is the line between the leading edge LE and trailing edge TE at each cross-section of the blade as illustrated in FIG. 6. A pressure side 146 of the airfoil 134 faces in the general direction of rotation as indicated by an arrow V and a suction side 148 is on the other side of the airfoil. A mean-line ML is generally disposed midway between the two sides in the chordwise direction.

The leading edge section 150 of the blade 108 extends along the leading edge LE of the airfoil 134 from the blade platform 136 to the blade tip 138. The leading edge section 150 includes a predetermined first width W such that the leading edge section 150 encompasses an area where nicks 54 (shown in phantom) and tears that may occur along the leading edge of the airfoil 134 during engine operation. The airfoil 134 subject to a significant tensile stress field due to centrifugal forces generated by the blade 108 rotating during engine operation. The airfoil 134 is also subject to vibrations generated during engine operation and the nicks and tears operate as high cycle fatigue stress risers producing additional stress concentrations around them.

To counter fatigue failure of portions of the blade along possible crack lines that can develop and emanate from the nicks and tears, the laser shock peened patch 145 is placed along a portion of the leading edge LE where incipient nicks and tears may cause a failure of the blade due to high cycle fatigue. The laser shock peened patch 145 is placed along a portion of the leading edge LE where an exemplary predetermined first mode line LM of failure may start for a fan or compressor blade. Within the laser shock peened patch 145, at least one and preferably both the pressure side 146 and the suction side 148 are simultaneously laser shock peened to form first and second oppositely disposed laser shock peened surface portions 152 and 153 and a pre-stressed blade regions 156 and 157, respectively, having deep compressive residual stresses imparted by laser shock peening (LSP) extending into the airfoil 134 from the laser shock peened surfaces as seen in FIG. 6. The pre-stressed blade regions 156 and 157 are illustrated along only a portion of the leading edge section 150 but may extend along the entire leading edge LE or longer portion thereof if do desired.

The low energy first and second laser beams 102 and 103, respectively, are arranged to simultaneously laser shock peen longitudinally spaced apart opposite convex suction and concave pressure sides 148 and 146, respectively, along a leading edge LE of an airfoil 134 of the blade 108 within the patch 145. The method form pairs or couples of first and second laser shock peened spots 158 and 159, respectively, wherein the pair of spots are longitudinally spaced apart a longitudinal distance LD and transversely offset from each other as indicated by a transverse offset OS with respect to the longitudinal distance as more particularly shown in FIG. 3.

The convex suction and concave pressure sides 148 and 146 have first and second laser shock peening surfaces 152 and 153, respectively, within the patch 145 on opposite sides of the blade 108. The first and second laser shock peening surfaces 152 and 153, respectively, are covered with an ablative coating such as paint or adhesive tape to form a coated surface as disclosed in U.S. Pat. Nos. 5,674,329 and 5,674,328. The paint and tape provide an ablative medium over which is placed a clear containment media which is typically a clear fluid curtain such as a flow of water 121.

The blade 108 is continuously moved during the laser shock peening process, while, the laser shock peening system 10 is used to continuously simultaneously firing the stationary first and second laser beams 102 and 103 through the curtain of flowing water 121 on the coated first and second laser shock peening surfaces 152 and 153 forming the laser shock peening spots 158. The curtain of water 121 is supplied by a water nozzle 123 at the end of a water line 119 connected to a water supply pipe 120. A controller 24 that is used to monitor and/or control the laser shock peening system 10.

The embodiment illustrated in FIGS. 1 and 2 uses longitudinally parallel and transversely spaced apart low energy first and second laser beams 102 and 103 that are set up or aimed such that first and second centerlines CL1 and CL2 of the first and second laser beams, respectively, impinge first and second surface portions referred to herein as first and second surface portions 152 and 153, respectively, within the patch 145 on the opposite convex suction and concave pressure sides 148 and 146 of the airfoil 134. The first and second laser beams 102 and 103 are then simultaneously fired with sufficient energy to vaporize material on the first and second surface portions 152 and 153 to form first and second regions having deep compressive residual stresses extending into the airfoil 134 of the blade 108 or other article from the first and second laser shock peened surface portions, respectfully.

Figure 3:
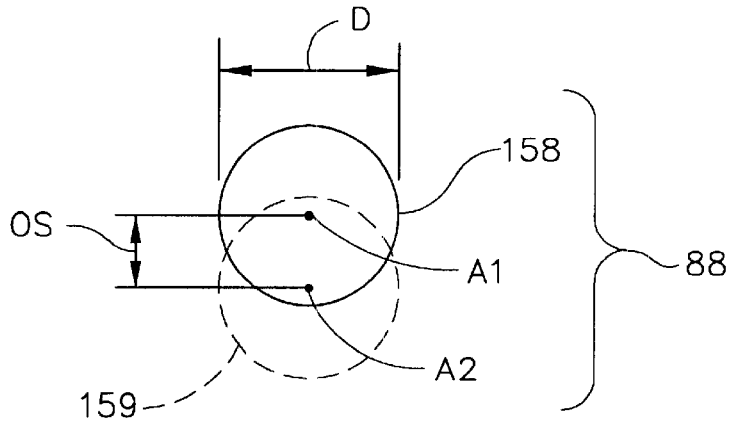
FIG. 3 is a diagrammatic illustration of the offset laser shock peened spots.

The first and second laser beams 102 and 103 are aimed such that the first and second centerlines CL1 and CL2 impinge the first and second surface portions 152 and 153 at first and second laser beam centerpoints A1 and A2 through which pass parallel first and second axes AX1 and AX2 that are substantially normal to the first and second surface portions at the first and second laser beam centerpoints, respectfully, and such that the first and second axes that are offset a transverse offset OS as further illustrated in FIG. 3. In one embodiment, good results were obtained using an approximately 0.075 inch offset OS and a circular spot diameter D equal to about 0.25 inches. Other tests having good results were made with 0.100, 0.120, 0.150, and 0.187 inch offsets OS using flat rectangular coupons to simulate the leading edge of an airfoil.

Figure 4:
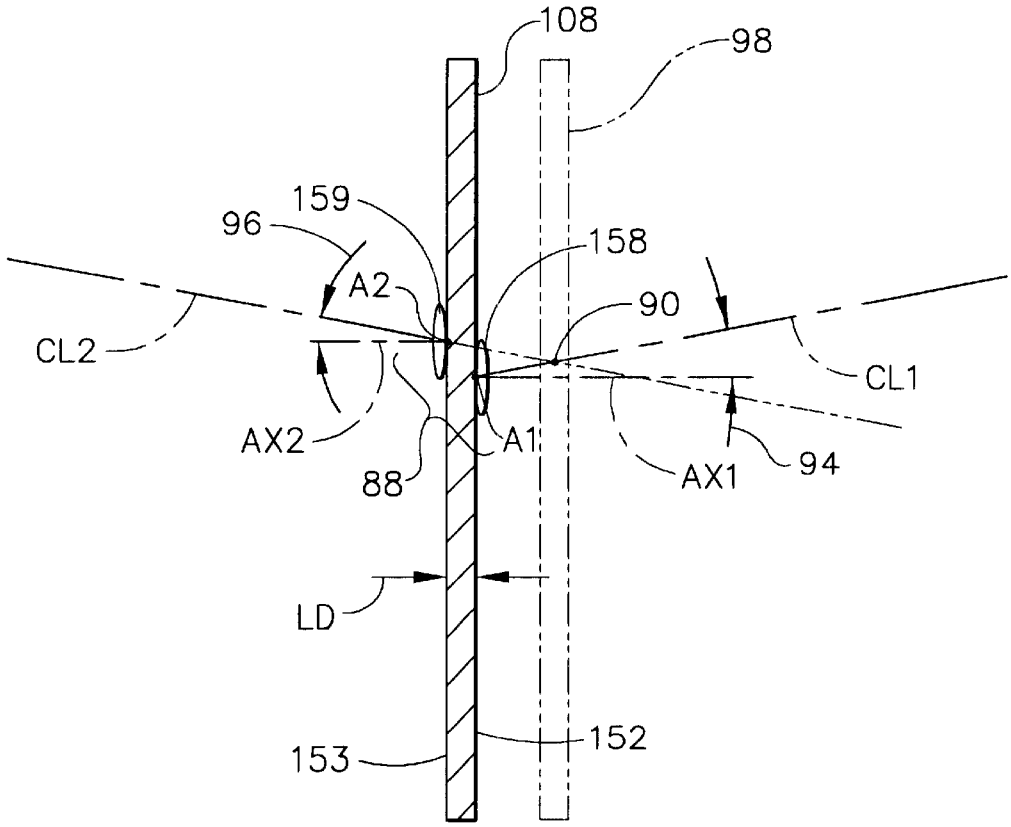
FIG. 4 is a diagrammatic illustration of a method for forming the offset laser shock peened spots with slightly angled and converging laser beams according to another exemplary embodiment of the method of the present invention.

Illustrated in FIG. 4 is another embodiment of the present invention in which the first and second laser beams 102 and 103 are aimed such that the first and second centerlines CL1 and CL2 intersect at an apex 90 and are angled with respect to each other and form first and second angles 94 and 96 with parallel first and second axes AX1 and AX2 that are substantially normal to the first and second surface portions 152 and 153 at first and second laser beam centerpoints A1 and A2, respectfully. One currently used laser shock peening system impinges its laser beams with six degree angle off a normal to the article's laser shock peening surface. The article or blade is fed into a crossing point of the beams where the beams' centerlines cross at the apex as indicated by the blade drawn in phantom line 98. When the article is fed to the crossing point, the first and second laser shock peened spots 158 and 159 are formed on both sides simultaneously and are centered along the same longitudinal path or, in other words, the first and second axes AX1 and AX2 are collinear. For the present invention, the blade is fed longitudinally offset to the side of one of the laser beams and then the laser spots from both sides are formed at different longitudinal path and the first and second axes AX1 and AX2 are transversely offset and non-collinear.

In general but not necessarily, the first and second surface portions 152 and 153 and hence the first and second laser shock peened spots 158 and 159 are substantially parallel. The first and second laser shock peened spots 158 and 159 are illustrated as being circular, however, they may have elliptical, oval, or other shapes. The present invention includes a laser shock peened article having laser shock peened first and second surface portions 152 and 153, respectively. First and second regions 156 and 157 having deep compressive residual stresses extend into the blade 108 from the first and second laser shock peened surface portions, respectfully. Couples 88 of simultaneously laser shock peened first and second spots 158 and 159, respectively, are longitudinally spaced apart the longitudinal distance LD and formed by the laser shock peening process on the first and second surface portions 152 and 153 such that each of the simultaneously laser shock peened first and second spots in a given couple have a transverse offset OS from each other with respect to the longitudinal distance.

The low energy first and second laser beams 102 and 103 have low energy levels on the order of 3–10 joules or even perhaps 1–10 joules to allow smaller less expensive lasers to be used as disclosed in U.S. Pat. No. 5,932,120, entitled "Laser Shock Peening Using Low Energy Laser". An energy level range of about 3–7 joules has been found particularly effective as has a level of about 3 joules. The low energy level laser beams are focused to produce the small diameter first and second circular laser spots 158 and 159 having a diameter D in a range of about 1 mm (0.040 in.) to 2 mm (0.080 in.). The area of the spots are about 0.79–3.14 square millimeters or about 0.0013–0050 square inches. The lower energy range has shown very good results and the 3 joules laser is quite adequate, produces good laser shock peening results, and is very economical to use, procure, and maintain. These energy ranges result in surface laser energy densities of approximately between 400 joules/(square cm) down to 100 joules/(square cm), respectively. A temporal profile of each pulse having a duration in a range of about 20 to 30 nanoseconds and a rise time less than about 10 nanoseconds has been found particularly effective. Another more particular profile of each pulse includes a rise time about 4 nanoseconds and the energy of the laser beams being about 3 joules.

Figure 7:
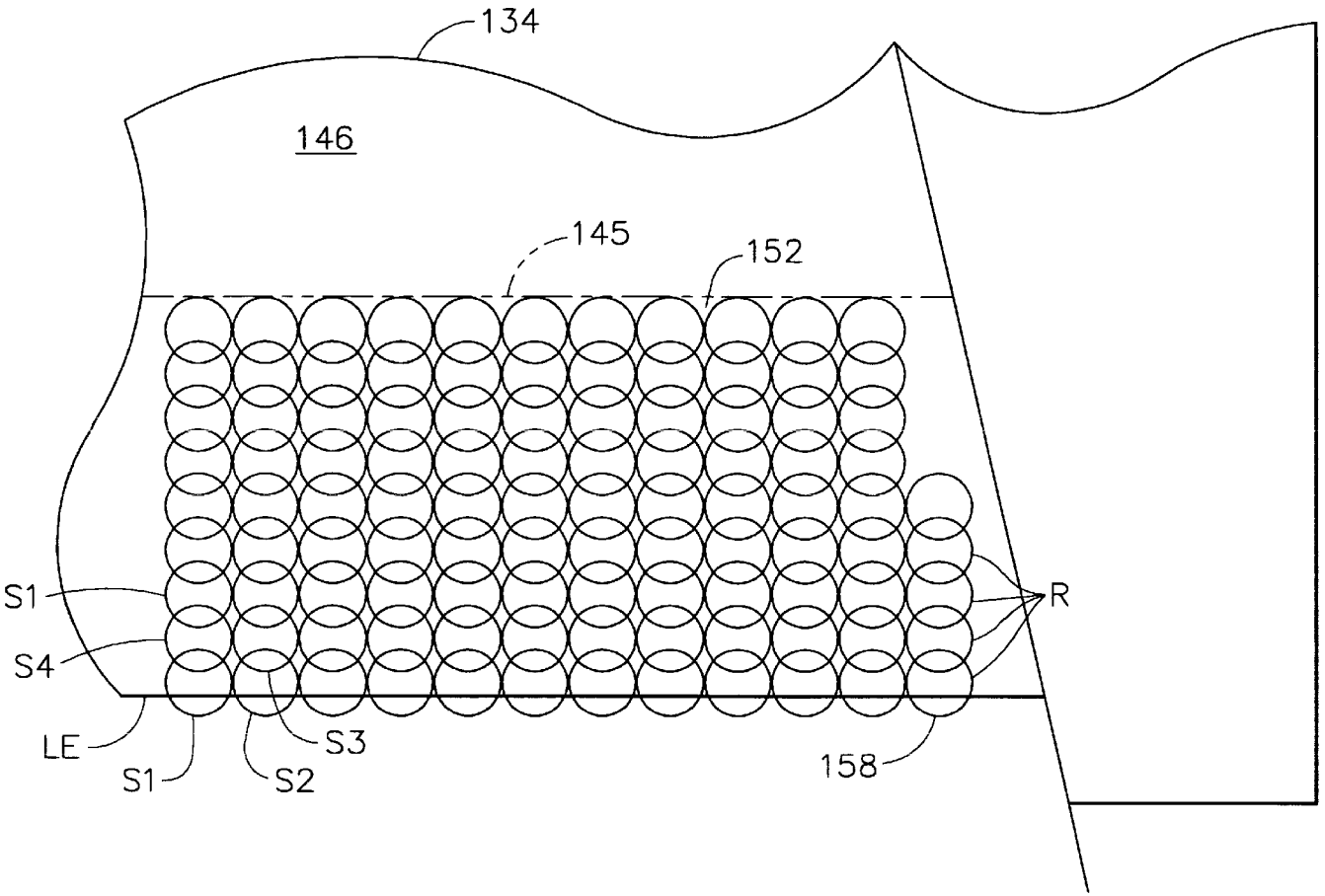
FIG. 7 is a schematic layout of the laser shock peening spots locations on the patch in FIG. 5.

FIG. 7 illustrates 9 overlapping rows R, more or fewer rows may be used, of the overlapping first laser shock peening spots 158 and one embodiment of the present invention adjacent ones of the laser shock peening spots 158 are laser shock peened on different passes and the patch 145 may be re-coated between the passes. Adjacent ones of the rows R of the overlapping laser shock peening spots 158 and adjacent ones of the overlapping laser shock peening spots typically having an overlap of about 30% and the laser shock peening spots are typically about 0.25 inches.

Thus, the first and second laser beams 102 and 103 are aimed and fired in a manner to produce first and second patterns on the first and second surface portions 152 and 153, respectively, of the article having overlapping adjacent rows of overlapping adjacent one of the first and second spots, respectively. In a more particular embodiment, the first and second patterns are formed by continuously moving the article while holding stationary and continuously firing the laser beams with repeatable pulses with relatively constant periods between the pulses, wherein the surface portions are laser shock peened using sets of first through fourth sequences S1 through S4, respectively. Each of the first through fourth sequences S1–S2 includes continuously firing the laser beams on the surface portions such that on each of the surface portions adjacent ones of the laser shock peened spots are hit in different ones of the sequences in the sets. More than one set may be used such that each spot is hit with a laser beam more than once. A more particular embodiment includes coating the surface portions with an ablative coating before and in between each of the sequences in the set.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A method for laser shock peening an article, said method comprising:

aiming and then simultaneously firing low energy first and second laser beams with sufficient energy to vaporize material on first and second surface portions of the article to form first and second regions having deep compressive residual stresses extending into the article from the first and second laser shock peened surface portions, respectfully, said aiming comprising aiming the first and second laser beams such that first and second centerlines of the first and second laser beams impinge the first and second surface portions at first and second laser beam centerpoints through which pass parallel first and second axes that are substantially normal to the first and second surface portions at the first and second laser beam centerpoints, respectfully, such that the first and second axes are offset and first and second centerlines are non-collinear, and each of the low energy first and second laser beams having a level of energy of about between 1–10 joules.

2. A method as claimed in claim 1, wherein the first and second laser beams are aimed such that the first and second centerlines intersect and are angled with respect to each other.

3. A method as claimed in claim 1, wherein the first and second laser beams and the first and second centerlines are parallel and offset with respect to each other.

4. A method as claimed in claim 1 further comprising using a temporal profile of each pulse having a duration in a range of about 20 to 30 nanoseconds and a rise time less than about 10 nanoseconds.

5. A method as claimed in claim 4 wherein the rise time is about 4 nanoseconds and the energy of the laser beams is about 3 joules.

6. A method for laser shock peening an article, said method comprising:

aiming and then simultaneously firing non-collinear low energy first and second laser beams with sufficient energy to vaporize material on first and second surface portions of the article to form first and second regions having deep compressive residual stresses extending into the article from the first and second laser shock peened surface portions respectfully, and simultaneously producing longitudinally spaced apart first and second laser shock peened spots that are transversely offset from each other are non-collinear, and each of the low energy first and second laser beams having a level of energy of about between 1–10 joules.

7. A method as claimed in claim 6 wherein the first and second spots are substantially parallel.

8. A method as claimed in claim 6 wherein the laser beams are aimed and fired in a manner to produce first and second patterns on the first and second surface portions of the article having overlapping adjacent rows of overlapping adjacent ones of the first and second spots, respectively.

9. A method as claimed in claim 8 wherein forming the first and second patterns further comprises continuously moving the article while holding stationary and continuously firing the laser beams with repeatable pulses with relatively constant periods between the pulses wherein the first and second surface portions are laser shock peened using sequences wherein each sequence comprises continuously moving the article while continuously firing the stationary laser beams on the surfaces such that on each of the surface portions adjacent ones of the laser shock peened spots are hit in different ones of the sequences in the set.

10. A method as claimed in claim 9 further comprising coating the surface portions with an ablative coating before and in between the sequences in the set.

11. A method as claimed in claim 6 wherein the article is a gas turbine engine airfoil and the first and second surface portions are on pressure and suction sides, respectively, of the airfoil along a leading edge of the airfoil.

12. A method as claimed in claim 11 wherein the laser beams are aimed and fired in a manner to produce first and second patterns on the first and second surface portions of the airfoil having overlapping adjacent rows of overlapping adjacent ones of the first and second spots, respectively.

13. A method as claimed in claim 12 wherein forming the first and second patterns further comprises continuously moving the article while holding stationary and continuously firing the laser beams with repeatable pulses with relatively constant periods between the pulses wherein the first and second surface portions are laser shock peened using sequences wherein each sequence comprises continuously moving the article while continuously firing the stationary laser beams on the surfaces such that on each of the surface portions adjacent ones of the laser shock peened spots are hit in different ones of the sequences in the set.

14. A method as claimed in claim 13 further comprising coating the surface portions with an ablative coating before and in between the sequences in the set.

15. A method as claimed in claim 6 further comprising using a temporal profile of each pulse having a duration in a range of about 20 to 30 nanoseconds and a rise time less than about 10 nanoseconds.

16. A method as claimed in claim 15 wherein the rise time is about 4 nanoseconds and the energy of the laser beams is about 3 joules.

17. A method for laser shock peening an article, said method comprising:

aiming and then simultaneously firing low energy first and second laser beams with sufficient energy to vaporize material on first and second surface portions of the article to form first and second regions having deep compressive residual stresses extending into the article from the first and second laser shock peened surface portions, respectfully, said aiming comprising aiming the first and second laser beams such that first and second centerlines of the first and second laser beams impinge the first and second surface portions at first and second laser beam centerpoints through which pass parallel first and second axes that are substantially normal to the first and second surface portions at the first and second laser beam centerpoints, respectfully, such that the first and second axes are offset and first and second centerlines are non-collinear, and each of the low energy first and second laser beams having a level of energy of about between 3–7 joules.

18. A method as claimed in claim 17, wherein the first and second laser beams are aimed such that the first and second centerlines intersect and are angled with respect to each other.

19. A method as claimed in claim 17, wherein the first and second laser beams and the first and second centerlines are parallel and offset with respect to each other.

20. A method for laser shock peening an article, said method comprising:

aiming and then simultaneously firing non-collinear low energy first and second laser beams with sufficient energy to vaporize material on first and second surface portions of the article to form first and second regions having deep compressive residual stresses extending into the article from the first and second laser shock peened surface portions, respectfully, and simultaneously producing longitudinally spaced apart first and second laser shock peened spots that are transversely offset from each other are non-collinear, and each of the low energy first and second laser beams having a level of energy of about between 3–7 joules.

21. A method as claimed in claim 20 further comprising using a temporal profile of each pulse having a duration in a range of about 20 to 30 nanoseconds and a rise time less than about 10 nanoseconds.

22. A method as claimed in claim 21 wherein the rise time is about 4 nanoseconds and the energy of the laser beams is about 3 joules.

* * * * *